US005293890A

United States Patent [19]

Park et al.

[11] Patent Number: 5,293,890

[45] Date of Patent: Mar. 15, 1994

[54] DEVICE FOR TENSIONING STRUCTURES

[75] Inventors: Brian W. Park; Wendy C. Park, both of Colchester, England

[73] Assignee: Relum Limited, Suffolk, United Kingdom

[21] Appl. No.: 873,397

[22] Filed: Apr. 24, 1992

[51] Int. Cl.[5] ..... E04H 15/28

[52] U.S. Cl. ..... 135/98; 135/104; 403/343

[58] Field of Search ..... 135/98, 99, 102, 104, 135/20.3, 28, 102; 248/228; 403/343

[56] References Cited

U.S. PATENT DOCUMENTS

| | | | |
|---|---|---|---|
| 2,953,145 | 9/1960 | Moss et al. | 135/98 X |
| 3,794,054 | 2/1974 | Watts | 135/119 X |
| 4,637,748 | 1/1987 | Beavers | 135/98 X |
| 4,750,509 | 6/1988 | Kim | 135/98 X |
| 4,966,178 | 10/1990 | Eichhorn | 135/98 X |
| 4,971,090 | 11/1990 | Uhl | 135/98 |
| 4,998,552 | 3/1991 | Niksie et al. | 135/102 |

FOREIGN PATENT DOCUMENTS

| | | |
|---|---|---|
| 483528 | 9/1938 | United Kingdom . |
| 2237193 | 5/1991 | United Kingdom . |

*Primary Examiner*—Carl D. Friedman
*Assistant Examiner*—Lan Z. Mai
*Attorney, Agent, or Firm*—Foley & Lardner

[57] ABSTRACT

A device for splaying a plurality of pole members from a generally axial orientation to a generally radial orientation, the device including a pair of generally parallel disc-like transverse members, each pole member having a first end pivotally mounted on one of the transverse members and a lever and cam mechanism for urging the transverse members axially together to clamp the first end of each pole member in a generally radial orientation.

11 Claims, 3 Drawing Sheets

DEVICE FOR TENSIONING STRUCTURES

The present invention relates to a device for tensioning structures, notably to a device for tensioning support rods in a structure by splaying the rods.

BACKGROUND TO THE INVENTION

In one form of construction of a tent or other temporary shelter, flexible poles are inserted into one or more locating sleeves formed along at least two diameters of a generally dome shaped shell of the tent wall fabric so that the poles extend from the apex of the dome to slightly beyond the periphery of the wall of the tent. The tent is erected by laying the fabric out flat and inserting a pole into the appropriate sleeve or sleeves so that the pole extends diametrically across the laid out fabric. Second and subsequent poles are inserted into other sleeves to form a radiating series of poles crossing at the apex of the tent. The foot of one pole is then inserted into a pocket formed at or adjacent the periphery of the wall at that diameter. The other end of that pole is inserted into a pocket located at or adjacent the periphery of the wall at a position diametrically opposed to the first pocket. Since the length of the diameter across the tent fabric is less than that of the pole, this causes the pole to bow and tension the fabric of the tent wall along that diameter. This operation is repeated with the other poles to give a semi-rigid, stable, dome-like structure in which the fabric of the tent wall is held taut by the bowed poles without the need for any internal struts or supports.

Such tents are in theory simple to produce and erect and find widespread use. They can be produced in a number of different forms and sizes for different end uses; for example as a single man tent to provide cover for beach fishermen or bird watchers, as larger polygonal shaped tents to house several people, or as small units to serve as cloches for the growing of plants. For convenience, the term dome tent will be used herein to denote in general structures which comprise a flexible wall member which is tensioned by bowing a series of radially arranged pole members supporting the wall fabric. Such a tent employing a tensioning arrangement is shown in U.S. Pat. No. 4,966,178 issued Oct. 30, 1990 to Eichhorn.

However, such dome tents suffer from the problem that they are assembled from a number of component parts and can be difficult to erect single-handedly since it is necessary to insert opposed ends of the poles into the pockets and at the same time to lift the poles so that they adopt their bowed configuration. Furthermore, even when two or more people work together in erecting such a tent, difficulties are still encountered in that once the first pole has been bowed, a structure is formed which can be caught by the wind before further poles can be put in position and the erected tent secured to the ground.

We have now devised a method for splaying the poles in a dome tent which reduces the above problems and which provides a structure which can be rapidly and simply erected single-handedly.

SUMMARY OF THE INVENTION

Accordingly, the present invention provides a device for splaying a plurality of pole members from a generally axial orientation to one in which at least part of each of the poles adopts a generally radial orientation, and for securing a first end of those members within the device to retain said radial orientation, which device comprises:

a. a pair of generally parallel transverse members capable of axial movement relative to one another and of receiving first ends of the pole members between said transverse members whereby the said first ends extend radially over at least part of the transverse members;

b. means for pivotally connecting said pole members at or adjacent the said first ends thereof to one of said transverse members; and c. means for urging said transverse members axially together thereby to clamp the said first ends of said pole members between the opposed faces of said transverse members whereby the first ends of said pole members are caused to adopt a generally radial orientation between said transverse members.

Preferably, the pole members are attached to the transverse members by means of a pivotal mounting and form an integral part of the device.

Preferably, the transverse members are provided by circular or polygonal discs having recesses in at least one of their opposed faces to receive and guide the first ends of the pole members so that the tips of the ends of the pole members between the transverse members follow a substantially radial path with respect to the axial axis of the device as the two transverse members are urged axially towards one another. It is also preferred that the pole members are secured to one of the transverse members by pins or other pivot means so that the pole members splay from a generally axial orientation to a partially radial orientation by pivoting about a fixed pivot point as the first ends of the poles are clamped between the transverse members.

In a particularly preferred form of the device, the transverse members comprise two generally parallel disc-like members either or both having radial grooves or recesses in the opposed faces thereof to form channels to receive and guide the first ends of a plurality of generally circular cross-section tubular or rod members which are secured to one of the disc-like members by transverse pivot mountings whereby the tube or rod members can pivot from a position at which their longitudinal axes lie generally parallel to the axial axis of the disc-like members to adopt a position radial to the axial axis; and an axially acting clamping means which comprises a lever and cam mechanism for moving the disc-like members axially upon an axial shaft member upon which the disc-like members are journalled so as to trap the first ends of the pole members between the disc-like members and urge them to adopt a radial orientation.

As indicated above, the device is of especial use in splaying the support poles of a tent or other structure in which the poles support a generally conical, dome-like or pyramidal fabric shell. In this case the free, foot, end of each of the pole members is secured, for example in a suitable pocket, at or adjacent the periphery of the fabric shell. As the upper, first, ends of the pole members are caused to adopt a radial orientation as the two transverse members are moved together, the poles are caused to bow and tension the fabric to form a self-supporting structure without the need for internal supports. For convenience, the invention will be described hereinafter in terms of such a tent structure, although it will be appreciated that the device of the invention finds use in the splaying of radial members in other applications, for example in splaying the spokes of a wheel whereby the circumference of the wheel can be varied by the extent to which the first ends of the spokes are clamped between the transverse members forming the hub to the wheel. The wheel can thus be used to tension the belt of a belt drive or belt conveyor to the desired extent.

It will be appreciated that the invention can be applied to the splaying of a wide range of numbers of pole members pivotally connected to one of the transverse members, for example from three to eight or more. Furthermore, it is not necessary that the poles be arranged so that they are in diametrically opposed pairs, as when even numbers of poles are used, but can be out of register radially with poles attached to the opposite periphery of the member, as when an odd number of poles is used, for example three or five poles. However, it is preferred that the poles be arranged symmetrically about the axis of the transverse member so that the stresses generated as the transverse members are clamped together are substantially uniformly distributed.

DESCRIPTION OF THE DRAWINGS

To aid understanding of the invention, it will now be described with respect to preferred embodiments thereof as shown in the accompanying drawings in which.

DESCRIPTION OF THE PREFERRED EMBODIMENTS

Figure 1:
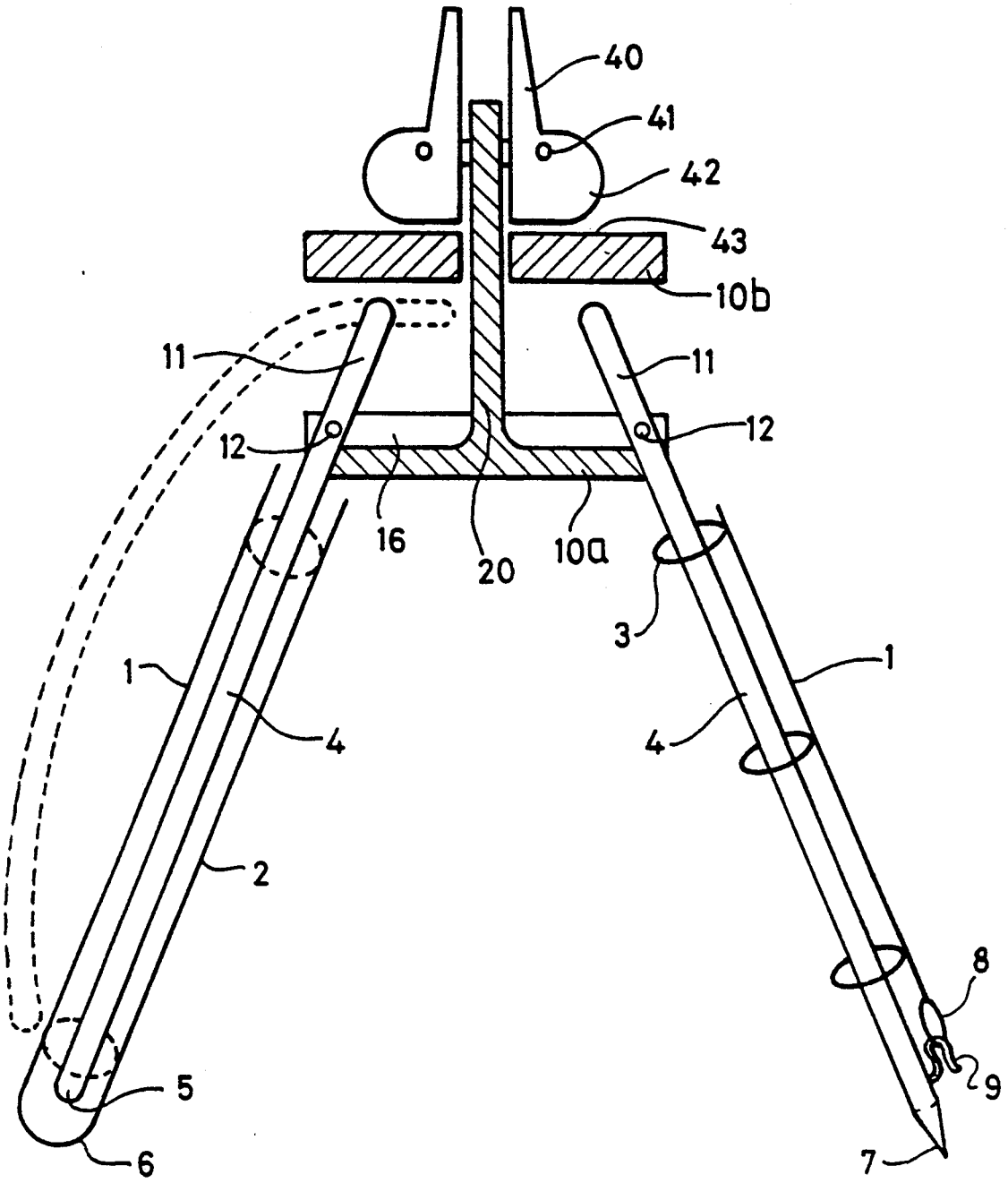
FIG. 1 is an axial sectional view through a tent embodying one form of the device of the invention.

The tent shown in FIG. 1 comprises four sectors of cotton, polyester or other suitable fabric joined along their edges to form a generally dome-like structure 1. It will be appreciated that the tent can have any desired number of sectors, for example three to eight, and that it can be of any suitable size or shape. The sectors can be provided with doors, windows or other features commonly used in the design and construction of a tent.

Along the radius at which a pole member is to be located, preferably at the join of each pair of the sectors of fabric, is formed a sleeve 2 of fabric into which the pole member can be inserted axially so as to located the pole radially and to retain it in this orientation with respect to the tent structure as the tent is erected. Alternatively, mounting loops or clips 3 are provided along those joins to receive the pole members. The poles members 4 are to splay and support the tent fabric walls. The pole members can be metal or other tubes or rods, preferably glass or other fibre reinforced plastic rods, which serve to support and tension the tent fabric to adopt the dotted configuration as shown in FIG. 1 when the tent is erected. The pole members can thus be of any suitable size and cross-section having regard to the size and weight of the tent they are to support. If desired, the pole members can be made collapsible or in sections to facilitate transport or storage. If desired, the pole members 4 can be cranked or otherwise configured where the tent wall is to adopt a form other than a simple cone, dome or pyramid.

The foot 5 of each pole member 4 is held at or adjacent the periphery of the wall of the tent in a pocket, for example the closed end 6 of the sleeve 2. Alternatively, the free ends of the pole members can be formed with a spiked end 7 for insertion into the ground and the fabric of the tent wall attached to a point adjacent the free end of the pole, for example by a suitable tie mechanism or by means of a rubber band 8 or other tensioning means acting between the foot of the tent wall and a hook 9 or other anchorage point on the pole members. The function of the pockets 6 or the anchorage means 8/9 is to restrain the tent fabric from excessive axial movement upon the pole members 4 when the latter are splayed as described below.

At the apex of the tent structure is mounted a device of the invention for splaying the pole members 4 to tension the wall fabric of the tent to form a self-supporting structure. The device shown in FIG. 1 comprises two opposed transverse discs 10*a* and 10*b* having a gap between them, within which the upper, free, ends 11 of the pole members 4 lie. The ends 11 of the pole members 4 extend into the gap between the discs 10*a* and 10*b* for up to the radius of the discs, so that the ends 11 will effectively radiate from the centre point of the discs when the discs are clamped together as described below. However, where the tent structure is not symmetrical, as when it has a rectangular plan shape, the free ends 11 of the pole members may follow a chord on the discs 10 rather than a true radial line. For convenience, the invention will be described hereinafter in terms of a symmetrical structure in which the free ends 11 of the pole members 4 lie along radii of the discs 10.

Figure 2:
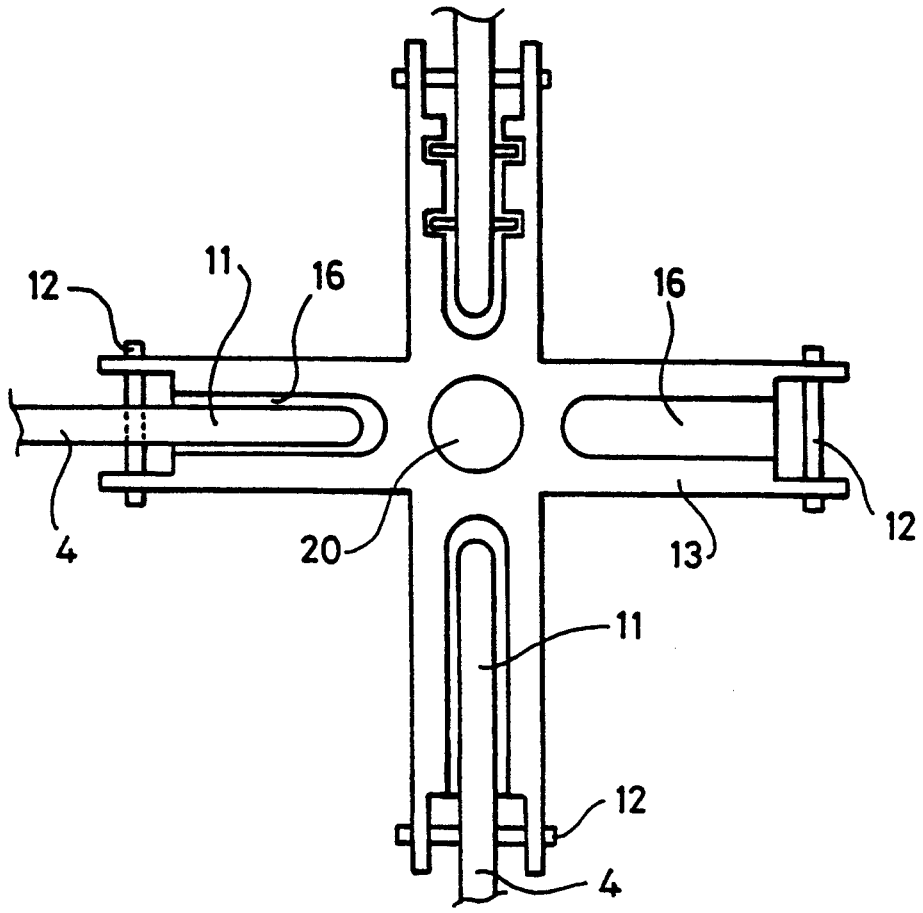
FIG. 2 is a plan view of an alternative form of the lower transverse member of the device of FIG. 1.

The pole members 4 are pivotally attached to one of the discs 10 so that they pivot about an axis normal to the radius on which the axis of the free end 11 lies. This pivot can be achieved by a pin type mounting 12 carried at the ends of the arms 13 of a suitable spider assembly forming one of the discs 10 as shown in FIG. 2, or by means of a transverse pin 12 passing through a cut out in the disc 10 into which the free end 11 of a pole member 4 locates as shown in FIG. 1.

Figure 3:
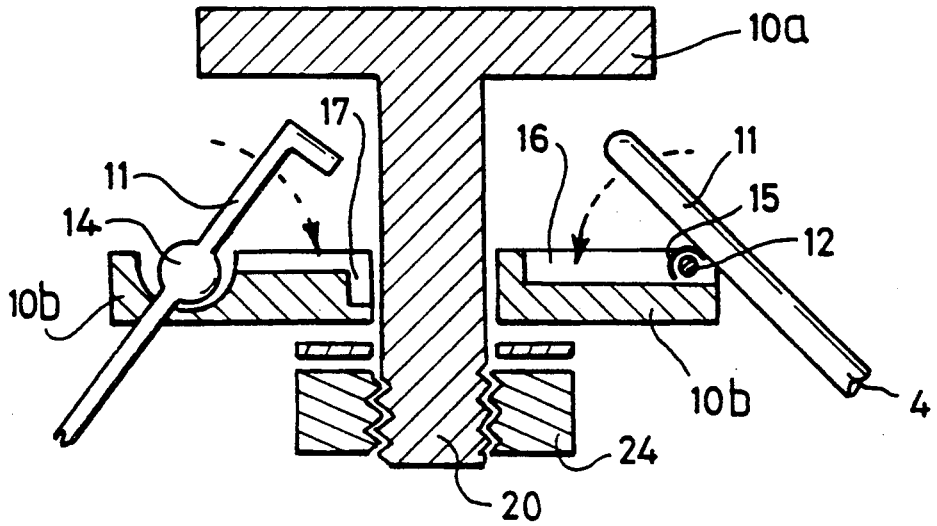
FIG. 3 is an axial section through another form of the device of FIG. 1 having an alternative form of clamping means.

It may be preferred that the pivot mounting be demountable, so that the pole members 4 can be separated from the discs 10 for transport or storage. Thus, as shown in FIG. 3, the pivot can be achieved by means of a ball and socket joint 14 from which the pole member 4 can be withdrawn axially for disassembly; or by means of a hook 15 on the pole member 4 engaging the pivot pin 12 of a disc 10 or spider arm 13 as shown in FIGS. 1 or 2.

For convenience, the invention will be described hereinafter in terms of a fixed pivot pin 12 passing through the shank of the pole member 4 as shown in FIG. 1. Such a construction provides a simple frame structure which requires the minimum of assembly when it is desired to erect a tent incorporating the device of the invention.

The pivot mounting allows the pole members 4 to adopt a position at which their longitudinal axes are generally parallel to the axial axis of the disc members 10 for storage and transport; but which allows the free ends 11 of the pole members 4 to adopt a radial orientation between the discs 10 when the latter are clamped together to trap the free ends 11 between them.

The free ends 11 of the pole members can be rounded and/or provided with low friction tips which bear against the faces of the discs 10 to assist relative movement between the ends 11 and the discs. Similarly, the faces of the disc members 10 can have a low friction surface, for example as when the discs 10 are made from a hard nylon or a machined polytetrafluoroethylene. If desired the tips of the free ends 11 of the pole members 4 can incorporate a ball, roller or similar rolling contact surface. It may be desired to form the tips of the free ends 11 of the pole members as replaceable parts to enable servicing and repair of the device to be achieved.

As indicated above, it is preferred that the disc members 10 carry grooves, channels or other means for guiding the ends of the free ends 11 of the pole members along a radial path and to reduce the tendency of the pole members to twist. Thus, as shown in FIG. 3, the lower disc 10*a* can have a radial recess 16 cut in its upper face to receive the free end 11 of the pole member 4 as it adopts its radial orientation between the discs 10. Alternatively, the groove 16 could be cut into the lower face of the upper disc 10*b* or could be cut partially into each disc. As shown in FIG. 3, the free end 11 of the pole member may also be cranked or otherwise bent at an angle to the axis of the pole member 4 so that it seats into a suitable recess 17 in a disc member 10; and/or as shown in FIG. 2, the free end 11 can carry cross members 18 which seat into suitable recesses 19 in the disc members 10 to further reduce the risk of a pole member 4 twisting as it adopts its splayed configuration.

The disc members 10 are mounted so that they can be moved axially with respect to one another. The axial movement clamps the free ends 11 of the pole members 4 between the opposed faces of the disc members 10 and forces the ends 11 of the pole members 4 to adopt a progressively radial as opposed to axial configuration. This causes the pole members to splay out about the axis of the disc members and to tension the fabric 1 carried by the pole members 4.

The axial movement of the disc members 10 can be achieved in a number of ways, but these will in general require that the two disc members be journalled on an axial shaft or support. With the form of device shown in FIG. 1, the two disc members are journalled upon an axial tube or shaft 20, with one disc 10*a* fixed to the shaft, the other disc 10*b* being free to move axially under the influence of a clamping means. In the device shown in FIG. 4, the discs are mounted within a drum-like structure 21 and either or both discs are free to move axially within the drum 21 under the influence of a screw or other clamping means 22.

Figure 4:
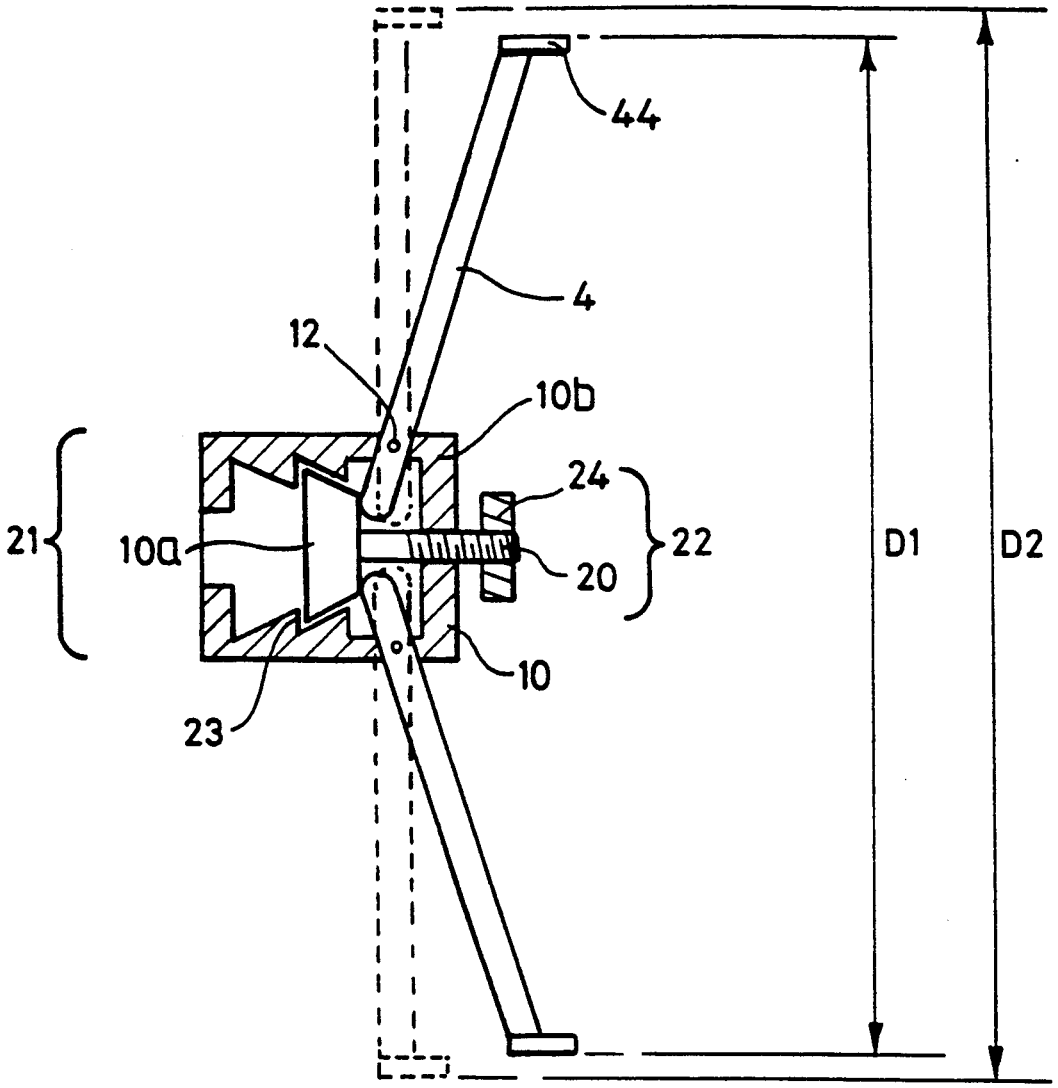
FIG. 4 is a an axial sectional view of a spoked wheel incorporating the device of the invention.

FIG. 4 also shows the use of a ratchet mechanism 23 to secure the discs against axial movement apart once they have been moved together to the desired extent. For convenience, the invention will be described hereinafter in terms of two disc members 10 mounted upon an axial shaft 20.

The disc members 10 are urged axially towards one another by a clamping mechanism to trap the free ends 11 of the pole members 4 between them. The clamping effort can be achieved as shown in FIG. 3 by a screw mechanism which moves one mobile disc 10*b* against a static second disc 10*a* by rotating a screw threaded nut 24 upon a screw threaded shaft 20 carrying the disc member 10*a* secured to the shaft and the other disc member 10*b* journalled for axial movement on the shaft 20. Alternatively, an over-centre or spring-loaded lever mechanism can be used to urge the two discs together and this can be actuated by a downward pull on a lever located within the tent structure. Alternatively, the clamping effect can be achieved by two opposed cammed surfaces acting on the two disc members 10 to urge them together when the cammed surfaces are rotated about the axis of the device, for example by lever arms.

However, the device of the invention is preferably mounted so that it is accessible to a user from outside the tent structure and is operated by a downward pressure forcing one disc member 10*b* to move towards a static second disc member 10*a*. Thus a particularly preferred clamping mechanism, as shown in FIG. 1, comprises a pair of diametrically opposed cammed levers 40 pivoting about two pivot points 41 on either side of the axis of the device and located above the upper disc member 10*b*. When the levers 40 are pulled apart, they pivot about pivots 41 and cause the cammed faces 42 to bear against the upper face 43 of the upper disc member 10*b* and force the disc 10*b* axially downward towards the lower disc 10*a*. The position of the pivot points is preferably selected so that the cams go over-centre to adopt a locked position with the discs 10*a* and 10*b* in the axially closed position. If desired, the action of the levers 40 can be spring assisted and/or locking pins can be provided to secure the levers in the over-centre position.

The shape of the cammed face 42 of the levers 40 defines the rate and extent of the axial movement of the disc members towards one another and can be selected to suit each given design of tent structure on which they are to be used.

The clamping mechanism can be mounted so that it acts on the lower disc 10*a* and is accessible from within the tent structure. However, we have surprisingly found that when it is mounted above the tent structure and acts on the upper disc 10*b* so that it is operated by a downward and radial pressure on the leer arms 40 by a user from outside the tent, the tendency for the pole members 4 to twist is reduced and erection of the tent is simplified.

Other forms of axially acting clamping mechanism may be devised for use in the present invention, and the invention is not to be construed as limited to the specific clamping mechanisms described herein.

The device of the invention can be made from any suitable material, for example steel or aluminium for the disc members and the clamping mechanism, and plastic for the tips of the pole members and the low friction faces of the discs.

The device of the invention can be applied to the manufacture of new tent frame structures or can be used in place of the conventional cross-over of the poles at the apex of an existing dome tent. The device provides a simple and robust mechanism device which can be operated single-handedly to erect a tent rapidly by a single action, thus reducing the risk that a partially erected tent could be caught by the wind. The device can be used in a wide range of tent like structures, for example single and multi-person tents or temporary shelters; greenhouses or cloches for the cultivation or protection of plants; and for site shelters to protect people or equipment from the weather.

FIG. 4 shows a wheel hub 21 incorporating a device of the invention to vary the splay of spokes 4 about the hub. By increasing the radial orientation of the spokes by tightening nut 24 on shaft 20, the effective diameter of the wheel can be increased from diameter D1 to diameter D2. As indicated above, the edge of disc 10*a* and the interior of the drum 21 can be formed with cooperating ratchet teeth 23 or other means so that the axial position of disc 10*b* within the drum can be locked. The spokes can carry flexible plates 44 which overlap to form a circumferential rim or support for the wheel. Such a wheel can thus be located as a tensioning wheel in a belt drive or conveyor system or as a variable gearing in a drive mechanism.

We claim:

1. A device for splaying a plurality of pole members from a generally axial orientation to one in which at least part of each of the pole members adopts a generally radial orientation, and for securing a first end of those members within the device to retain said radial orientation, which device comprises:

a. a pair of generally parallel disc-like transverse members journalled on an axial shaft member; said transverse members capable of axial movement relative to one another and of receiving first ends of the pole members between said transverse members whereby the said first ends extend radially over at least part of the transverse members;

b. means for pivotally connecting said pole members at or adjacent the said first ends thereof to one of said transverse members; and c. means for urging said transverse members axially together thereby to clamp the said first ends of said pole members between the opposed faces of said transverse members whereby the first ends of said pole members are caused to adopt a generally radial orientation between said transverse members said urging means comprising a lever and cam mechanism for moving the disc-like members axially upon said axial shaft member.

2. A device as claimed in claim 1, wherein the transverse members are provided by circular or polygonal discs having recesses in at least one of their opposed faces adapted to receive and guide the first ends of the pole members so that the pole members follow a substantially radial path with respect to the axial axis of the device as the two transverse members are urged axially towards one another.

3. A device as claimed in claim 1, wherein the pole members are attached to one of the transverse members by pins or other pivot means so that the pole members splay from a generally axial orientation to a partially radial orientation by pivoting about a fixed pivot point as the first ends of the pole members are clamped between the transverse members.

4. A device as claimed in claim 3, wherein the pole members are demountably attached to the transverse member.

5. A device as claimed in claim 1, wherein the transverse members comprise two generally parallel disc-like members either or both having radial grooves or recesses in the opposed faces thereof to form channels to receive and guide the first ends of a plurality of generally circular cross-section tubular or rod members which are attached to one of the disc-like members by transverse pivot mountings whereby the tube or rod members can pivot from a position at which their longitudinal axes lie generally parallel to the axial axis of the disc-like members to adopt a position radial to the axial axis.

6. A device as claimed in claim 1, wherein the pole members are arranged radially symmetrically about the axis of the device.

7. A device as claimed in claim 1, wherein the pole members are attached to a domelike fabric construction having the transverse members located at or adjacent the vertex of the construction and having the pole members attached at or adjacent the free ends thereof to the periphery of the fabric construction, whereby the pole members are adapted to deploy and tension the walls of the fabric construction when the first ends thereof are urged to adopt a radial orientation.

8. A device as claimed in claim 1, wherein the means for urging the transverse members axially together is provided by one or more cammed surfaces bearing against one or more of the transverse members.

9. A device as claimed in claim 1, wherein the cammed surfaces are mounted upon transverse pivot members located so that the cammed surfaces adopt an over.centre position thereby to retain the transverse members in the axially close position.

10. A device as claimed in claim 1, wherein the cammed surfaces are carried by lever members and are adapted to bear upon the upper transverse member.

11. A device as claimed in claim 1, wherein said pole members define a wheel-like structure whereby the radius of the wheel can be varied by urging the transverse members axially together.

* * * * *